United States Patent [19]

Randall

[11] Patent Number: 4,664,004

[45] Date of Patent: May 12, 1987

[54] CONSTANT-VOLUME SAMPLE CUTTER

[75] Inventor: Leslie L. Randall, Akron, Ohio

[73] Assignee: Monsanto Company, St. Louis, Mo.

[21] Appl. No.: 731,687

[22] Filed: May 8, 1985

[51] Int. Cl.[4] ..... B26F 1/14

[52] U.S. Cl. ..... 83/125; 83/375; 83/630; 83/919; 83/176

[58] Field of Search ..... 83/19, 20, 21, 176, 83/125, 123, 124, 375, 380, 630, 919; 100/98 R; 264/153

[56] References Cited

U.S. PATENT DOCUMENTS

| | | | |
|---|---|---|---|
| 176,332 | 4/1876 | Mauger | 83/630 X |
| 415,477 | 11/1889 | Stevens | 83/127 |
| 486,387 | 11/1892 | Snaith . | |
| 612,955 | 10/1898 | Morris . | |
| 1,037,056 | 8/1912 | Sauter | 83/630 X |
| 2,251,135 | 7/1941 | Iknayan | 83/19 |
| 2,275,525 | 3/1942 | Halmrast | 83/125 X |
| 2,773,549 | 12/1956 | Legarra et al. | 83/125 X |
| 3,724,308 | 4/1973 | Nichols | 83/630 X |
| 4,281,546 | 8/1981 | Fraleigh | 73/864 |
| 4,374,795 | 2/1983 | Keilp | 83/19 |
| 4,448,119 | 5/1984 | Williamson | 100/231 |

FOREIGN PATENT DOCUMENTS

| | | | |
|---|---|---|---|
| 529100 | 7/1931 | Fed. Rep. of Germany | 83/127 |
| 2119701 | 11/1983 | United Kingdom | 264/153 |

*Primary Examiner*—James M. Meister

*Attorney, Agent, or Firm*—Gordon B. Seward

[57] ABSTRACT

A cutting device for rubber samples produces constant-volume samples of rubber. The samples are suitable for testing, such as curemeter or rheometer testing, and their constant volume eliminates erratic test results caused by samples which are too large or too small. The device features a sizing mechanism which works in conjunction with a cutter, so as to ensure constant volume samples.

3 Claims, 2 Drawing Figures

CONSTANT-VOLUME SAMPLE CUTTER

BACKGROUND OF THE INVENTION

This invention relates to cutters for rubber samples, and to cutting machines having toggle mechanisms for reciprocal motion of a cutting die.

In the operation of rheometers or curemeters for evaluating the physical behavior of rubber compounds during the process of vulcanization, it has been found helpful for obtaining repeatability to charge the rheometer or curemeter with samples which are of consistent volume. The sample volume should be just slightly more than that required to fill the cavity of the testing device. If the sample volume is insufficient to fill the cavity, cavity pressure is inadequate and erroneous values will result. If the sample volume is significantly too large, an excess of rubber will be squeezed out of the cavity during the initial stages of the test, retarding sample heating and causing erratic results and also necessitating excessive cleaning effort. Thus, a device which could produce an accurate, constant volume of sample would be of value in maintaining testing accuracy and speed, especially in a quality control application, where samples are continually tested to monitor production operations.

It is an object of the present invention to provide a reliable, quick and relatively simple mechanical cutter which will produce constant-volume samples of rubber compound. It is another object of this invention to provide a method for cutting samples of rubber compound by first sizing, then cutting a portion of rubber compound to a constant volume.

SUMMARY OF THE INVENTION

The objects of the invention are achieved in a device which, as described below comprises an anvil, a piston and a cutter which, when actuated, cooperate to cut quick and accurate samples; also, in a method wherein a portion of material is first pressed to accurate size between an anvil and a piston, then cut to produce a constant volume of material.

In a preferred embodiment, the device of the invention is more completely described as follows: on a frame, containing upper and lower frame members connected by support members, at least one guide rod is attached (to one of the support members). A crosshead, carrying a cutter, is journalled on the guide rod. A piston is positioned inside the cutter, so that it slides freely through the cutter, and coaxially with an anvil. Drive means are connected to the frame and arranged to move both the cutter and the piston towards and away from the anvil.

A preferred method of the invention is as follows: a portion of material to be cut is first placed, in a thickness greater than the thickness of a desired sample, upon an anvil. Then the sample is pressed to the desired thickness and cut while being held. Finally, the sample is expelled from contact with the cutter.

A better understanding of the invention may be obtained by reference to the accompanying drawings and descriptions.

DESCRIPTION OF THE PREFERRED EMBODIMENT

Figure 1:
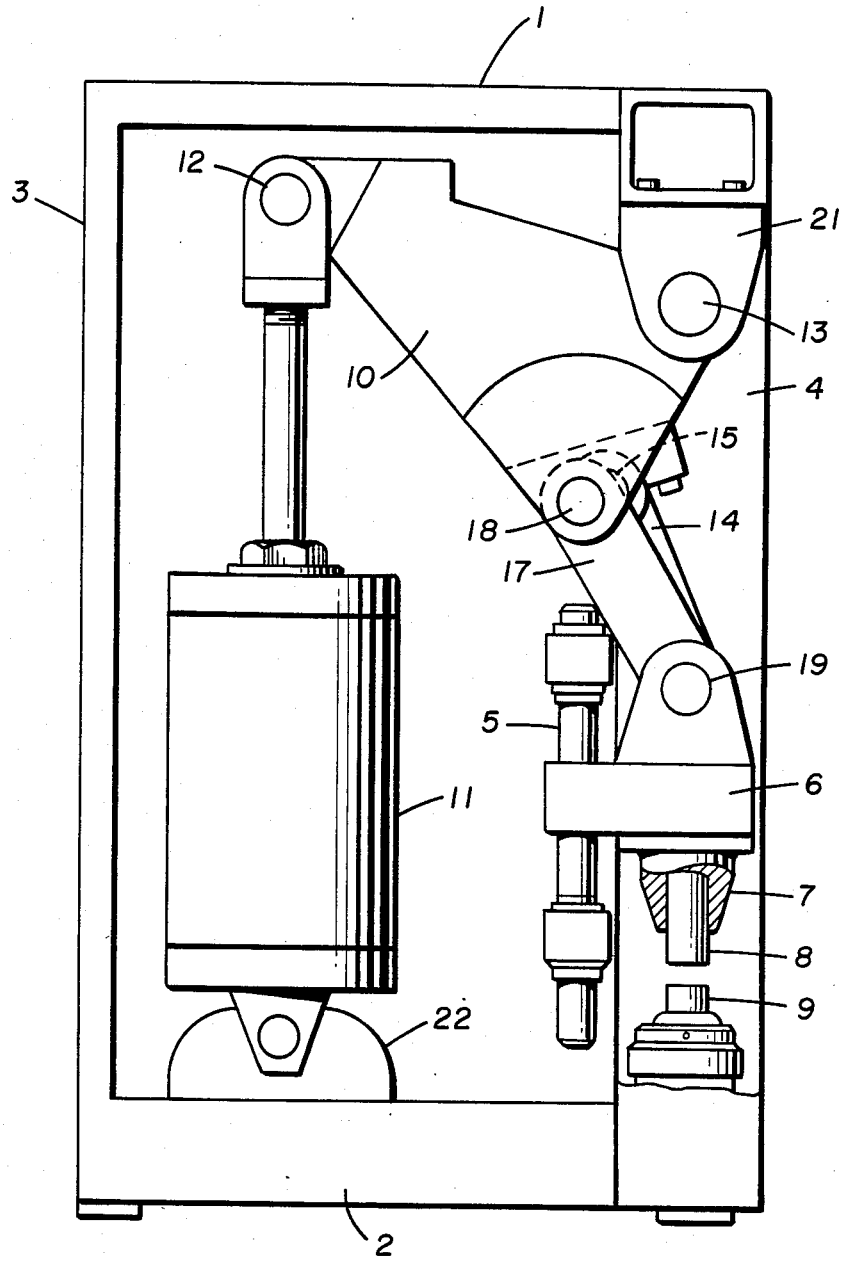
FIG. 1 is an elevation showing a preferred embodiment of the device of the invention in its open position, with a portion of the cutter and piston in relief.
Figure 2:
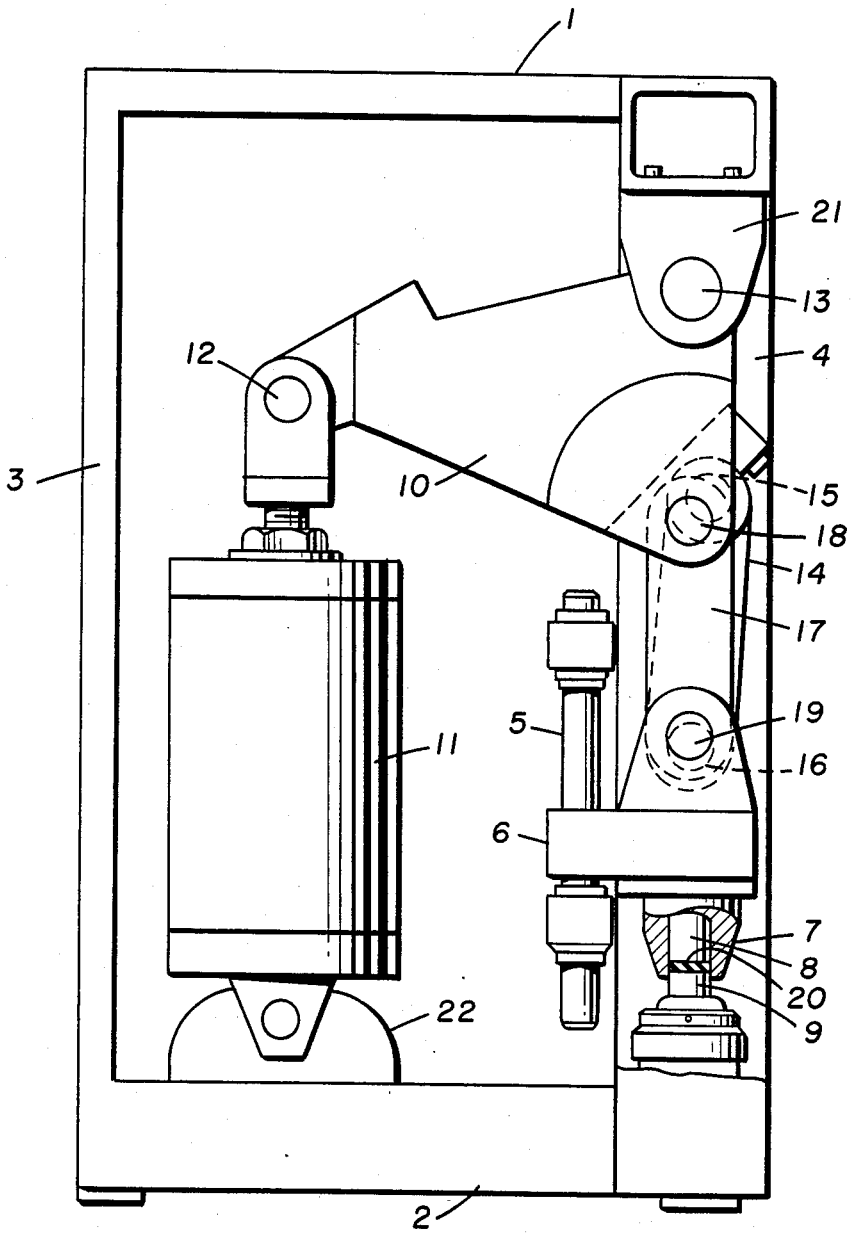
FIG. 2 is similar to FIG. 1, but shows the device in its closed position.

Referring to the drawings, a preferred embodiment of the device is shown in FIG. 1 in its open position, and in FIG. 2 in its closed position.

Upper frame member 1 is supported on lower frame member 2 by left and right supports 3, 4. Guide rod 5 is attached to right support 4, and crosshead 6 is journalled on guide rod 5 and onto another guide rod (behind rod 5, and not shown) for sliding motion up and down. Cutter 7 is attached to crosshead 6 and moves with it. Piston 8 is mounted within cutter 7 and is free to move up and down independent of cutter 7 and crosshead 6. Anvil 9 is supported on lower frame member 2, and is located coaxially with cutter 7 and piston 8.

Bellcrank 10 is pivotally mounted on ram 11 by means of ram pivot pin 12, and pivotally mounted to bracket 21 by means of main pivot pin 13. The opposite end of ram 11 is secured to lower frame member 2 by lug 22. Bracket 21, in turn, is attached to upper frame member 1. Piston link 14 is pivotally attached at one end to bellcrank 10 by means of upper piston link pin 15 and at its other end to the piston 8 by means of lower piston link pin 16. Cutter link 17 is similarly pivotally attached at one end to bellcrank 10 by means of upper cutter link pin 18 and at its other end to the crosshead 6 by means of lower cutter link pin 19.

The preferred operation of the cutting device of the invention is shown by reference to FIG. 1 and FIG. 2, showing the device first in its fully open position, then in its fully closed position. With the device in the fully open position as shown in FIG. 1, a portion of the material to be cut is placed on anvil 9, sized so its thickness is slightly larger than the desired thickness of the finished sample. By actuating ram 11 downward, bellcrank 10 is pivoted about main pivot pin 13, which forces both the crosshead 6, carrying the cutter 7, and the piston 8 downwards by means of the action of the toggle links 14 and 17. Piston 8 precedes cutter 7, and forces the material against anvil 9, to its desired thickness. Cutter 7 then slides past the piston 8, cuts the material, and the lowermost edge of Cutter 7 finishes just below the upper edge of anvil 9. The device is then in the fully closed position as shown in FIG. 2, with the sample 20 fully enclosed between the upper surface of anvil 9 and the lower surface of piston 8, and surrounded at its edge by cutter 7. The ram 11 is then actuated upward, first raising cutter 7 out of sliding contact with anvil 9, then sample 20. The retraction of cutter 7 thus expells sample 20 from contact with cutter 7 as the piston 8 protrudes through cutter 7, facilitating removal of the sample 20.

Although the device as pictured and described shows a combination of a single anvil, cutter and piston it is within the scope of the invention to provide plural or multiple combinations of anvil, cutter and piston driven by a single drive means so as to enable production of plural or multiple samples at one time.

The preferred biasing means for moving the cutter and piston is an air cylinder. However, any convenient biasing means can be adapted for this purpose, such as, for example a one-revolution clutch mechanism.

The usual shape of the desired sample is that of a cylinder the diameter of which is significantly greater than its height. Other shapes can be produced, if desired, and this invention is not limited to methods and devices for producing the pictured cylindrical samples.

Although the invention has been illustrated by typical examples, it is not limited thereto. Changes and modifications of the examples of the invention herein chosen for purposes of disclosure can be made which do not constitute departure from the spirit and scope of the invention.

The embodiments of the invention in which an exclusive property or privilege is claimed are defined as follows:

1. A cutting device, comprising in combination, upper and lower frame members connected by support members therebetween, at least one guide rod attached to one of the support members, a crosshead journalled on the guide rod for movement along the guide rod, a cutter attached to the crosshead, a piston positioned within the cutter for sliding movement therethrough, an anvil attached to the lower frame member in alignment with both the cutter and the piston, and drive means attached to one of the frame members and to both the cutter and the piston, which drive means, when actuated, moves both the cutter and the piston towards and away from the anvil, wherein the drive means comprises a bellcrank pivotally attached to biasing means, to the crosshead and the piston through separate toggle linkages and pivotally attached to one frame member.

2. The cutting device of claim 1, wherein the biasing means is a ram.

3. The cutting device of claim 2, wherein the ram is an air ram.

* * * * *